US011491670B1

(12) United States Patent
Helman et al.

(10) Patent No.: US 11,491,670 B1
(45) Date of Patent: Nov. 8, 2022

(54) BACON PORTIONER/TRIMMER

(71) Applicant: Fresh Mark, Inc., Massillon, OH (US)

(72) Inventors: Glen Christopher Helman, Lisbon, OH (US); Mark Edward Walker, East Liverpool, OH (US); Timothy Mark Calvin, Canfiled, OH (US)

(73) Assignee: Fresh Mark, Inc., Massillon, OH (US)

( * ) Notice: Subject to any disclaimer, the term of this patent is extended or adjusted under 35 U.S.C. 154(b) by 0 days.

(21) Appl. No.: 16/725,680

(22) Filed: Dec. 23, 2019

Related U.S. Application Data

(62) Division of application No. 12/422,325, filed on Apr. 13, 2009, now Pat. No. 10,513,044.

(60) Provisional application No. 61/044,064, filed on Apr. 11, 2008.

(51) Int. Cl.
*B26D 1/02* (2006.01)
*B26D 1/03* (2006.01)

(52) U.S. Cl.
CPC ..... *B26D 1/025* (2013.01); *B26D 1/035* (2013.01)

(58) Field of Classification Search
CPC .. B26D 1/025; B26D 1/035; B26D 2001/004; B26D 2007/082; B26D 2210/04; B26D 3/168; B26D 7/2642
See application file for complete search history.

(56) References Cited

U.S. PATENT DOCUMENTS 122,958 A 1/1872 Morrell
261,188 A 7/1882 Wake
280,457 A * 7/1883 Doherty et al. ..... B26D 3/185 83/425.3
361,707 A 4/1887 Matheis
427,128 A * 5/1890 Stearns ..... B26D 3/185 83/425.3
527,963 A * 10/1894 Gay ..... B23D 3/02 409/304
773,563 A * 11/1904 Ginn ..... B26D 1/245 83/122

(Continued)

FOREIGN PATENT DOCUMENTS

EP 2514583 B1 * 7/2014 ..... B26D 1/025
GB 2095638 10/1982

OTHER PUBLICATIONS

American Machine Products—Model 2000; Mar. 11, 2009 [date information captured via Wayback Machine]; < www.americanmachineproducts.com> (Year: 2009).*

*Primary Examiner* — Ghassem Alie
*Assistant Examiner* — Samuel A Davies
(74) *Attorney, Agent, or Firm* — Calfee, Halter & Griswold LLP

(57) ABSTRACT

Various systems, apparatuses and methods are disclosed for portioning and/or trimming cooked or pre-cooked bacon slices (or another food product) on a production line at full line speed. An exemplary system may comprise a food conveyor and a portioner. The food conveyor may have at least one transfer mechanism that carries bacon slices over at least one transfer comb. The portioner may have at least one fixed, stationary cutter positioned relative to the transfer comb in the path of the bacon slices. As the transfer mechanism moves the bacon slices across the transfer comb, the bacon slices contact the cutter and are moved by the transfer mechanism over the cutter, which cuts the bacon slices into two or more portions of shorter length.

20 Claims, 8 Drawing Sheets

(56) References Cited

U.S. PATENT DOCUMENTS 811,332 A * 1/1906 Rufli ..... B27B 25/04 144/242.1
824,641 A * 6/1906 Garrigus ..... B26D 3/161 83/411.6
1,291,811 A 1/1919 Ellis
1,356,271 A 10/1920 Dozier et al.
1,367,546 A 1/1921 Hirth et al.
1,546,866 A 7/1925 Randel
1,626,550 A * 4/1927 Miller ..... B26D 3/18 83/404.3
1,647,881 A * 11/1927 Olsen ..... B65H 35/0086 83/433
1,935,408 A 11/1933 Marino et al.
2,547,249 A 4/1951 Bell
2,829,683 A * 4/1958 Skinner ..... B27B 25/04 83/718
2,839,113 A * 6/1958 Townsend ..... A22C 17/12 99/538
2,858,866 A 11/1958 Hendry
3,010,499 A * 11/1961 Dahms ..... B26D 7/30 177/121
3,014,438 A * 12/1961 Seewer ..... A21C 3/02 425/196
3,096,801 A 7/1963 Miles et al.
3,115,169 A 12/1963 Rodriguez et al.
3,415,147 A * 12/1968 Frydryk ..... D06H 7/02 83/171
3,470,774 A 10/1969 Phelps
3,543,625 A * 12/1970 Rowland ..... B26D 1/025 83/433
3,596,693 A 8/1971 Baker
3,688,828 A 9/1972 Peterson
3,941,018 A 3/1976 Williams
4,016,625 A 4/1977 Mitchell
4,075,917 A * 2/1978 Kistner ..... B26D 1/147 83/422
4,329,900 A 5/1982 Dennis et al.
4,423,671 A 1/1984 Murphy
4,455,929 A 4/1984 Goudarzi et al.
4,538,492 A 9/1985 Van Lue et al.
4,554,850 A 11/1985 Edgar et al.
4,827,818 A * 5/1989 Stringfellow ..... B26D 5/10 83/858
5,018,417 A * 5/1991 Keister ..... B26D 7/2628 83/354
5,036,739 A 8/1991 Clar
5,197,364 A * 3/1993 Heutschi ..... B26D 1/0006 83/13
5,868,547 A * 2/1999 Cohn ..... B65B 25/08 414/789.5
6,079,191 A 6/2000 Borkiewicz et al.
6,368,647 B1 * 4/2002 Capodieci ..... A23G 7/0018 426/238
6,426,104 B1 * 7/2002 Leitinger ..... B26D 1/15 426/243
6,834,576 B2 12/2004 Leitinger
6,948,677 B2 9/2005 Biagiotti et al.
10,513,044 B1 12/2019 Helman et al.
2002/0117030 A1 * 8/2002 Gambaro ..... B26D 7/0683 83/13
2002/0166431 A1 * 11/2002 Benjamin ..... B26D 3/30 83/423
2003/0015075 A1 * 1/2003 Merkli ..... B26D 1/20 83/23
2004/0144226 A1 * 7/2004 West ..... C14B 5/00 83/62
2005/0079815 A1 * 4/2005 Johnson ..... A22C 17/0093 452/150
2007/0062356 A1 * 3/2007 Cavanagh ..... B26D 1/035 83/523
2016/0288357 A1 * 10/2016 Wildey ..... B26D 7/2614

* cited by examiner

BACON PORTIONER/TRIMMER

CROSS REFERENCE TO RELATED APPLICATIONS

This non-provisional application is a divisional of U.S. patent application Ser. No. 12/422,325 entitled "Bacon Portioner/Trimmer," filed Apr. 13, 2009, which issued as U.S. Pat. No. 10,513,044 on Dec. 24, 2019, and claims priority to, and any other benefit of, U.S. Provisional Patent Application No. 61/044,064 entitled "Bacon Portioner/Trimmer," filed Apr. 11, 2008, which is hereby incorporated by reference in its entirety. To the extent the foregoing application conflicts with the present application, the conflicting aspects are to be thought of in the alternative to the disclosures herein.

FIELD OF THE INVENTION

The present invention relates generally to a system, apparatus and method for portioning food products and more specifically to a system, apparatus and method for portioning cooked (or pre-cooked) bacon slices (e.g., into two about equal pieces) at full production line speed.

BACKGROUND

Continuous manufacturing systems and processes for pre-cooking or cooking bacon are known. Exemplary systems include microwave ovens that cook sliced bacon positioned on a first conveyor belt for a sufficient time to obtain desired properties, e.g., a selected doneness. The cooked bacon slices are then often transferred from the first conveyor belt to sheet of paper via a bacon sheeter. The bacon sheeter, for example an American Machine Products 2000-C bacon sheeter, transfers a plurality of the slices from the first conveyor belt onto a sheet of paper positioned on a second conveyor belt. Transfer means, such as wheels or belts, of the sheeter transfer the bacon slices from the first conveyor belt to a first end of a product transfer comb. For example, wheels in the American Machine Products 2000-C bacon sheeter rotate on a motor-driven axle (e.g., at about 28 revolutions per minute) and quickly move cooked or pre-cooked bacon slices across the product transfer comb, from the first end of the comb at the end of the first conveyor belt to a second end of the comb and feeds the cooked slices onto the sheet of paper positioned on the second conveyor belt. It is important that the sheeter maintain accurate piece counts and reasonably consistent placement of the bacon slices on the paper at full line speed (e.g., about 250 to 370 slices per minute). The bacon slices and paper are then transferred via the second conveyor belt to a packaging station.

It is desirable in the art to have bacon slices portioned into two or more approximately equal portions, e.g., for sandwiches. This "portioning" is often done by hand in which conventional, relatively long bacon slices (e.g., about 8.5 inches) are torn into two pieces of shorter length as a sandwich is assembled at a food preparation station. Conventional methods of portioning bacon slices in connection with cooking bacon include: (i) using a band saw to cut the raw pork bellies prior to slicing and cooking (so that the raw bacon slices are already about half the length of a conventional bacon slice before cooking and sheeting), and (ii) using pinch-type cutters to cut cooked bacon slices after placement on paper sheets, e.g., using a press that pinches the bacon and paper sheet to cut the bacon, but does not pinch through the paper sheet. These methods, however, have been proven to be labor intensive, expensive, imprecise, and/or slow (e.g., lower production rates).

SUMMARY

According to the present invention, various systems, apparatuses and methods are provided for portioning and/or trimming cooked or pre-cooked bacon slices (or another food product) on a production line at full line speed.

In one aspect, an exemplary system for portioning bacon slices on a production line is provided. The system may comprise a food conveyor and a portioner. The food conveyor may have at least one transfer mechanism that carries bacon slices over at least one transfer comb. The portioner may have at least one fixed, stationary cutter positioned relative to the transfer comb in the path of the bacon slices. As the transfer mechanism moves the bacon slices across the transfer comb, the bacon slices contact the cutter and are moved by the transfer mechanism over the cutter, which cuts the bacon slices into two or more portions of a shorter length.

In another aspect, an exemplary apparatus for portioning bacon slices on a production line is provided. The apparatus may comprise a transfer comb and a fixed, stationary cutter. The transfer comb may be configured to be positioned between at least one of two conveyor belts and a conveyor belt and a sheeter. The transfer comb may have a first end, a second end, and a curved top surface. The bacon slices may move across the top surface from the first end to the second end. The cutter may be removably attached to the transfer comb and positioned relative to the transfer comb in the path of the bacon slices. As the bacon slices move across the top surface of the transfer comb from the first end to the second end, the bacon slices contact the cutter and are moved over the cutter, which cuts the bacon slices into two or more portions of a shorter length.

In another aspect, a method of portioning bacon slices on a production line is provided. Bacon slices may be moved on a first food conveyor belt. The bacon slices may be transferred over a transfer comb using at least one transfer mechanism. The bacon slices may be cut into two or more portions of a shorter length using at least one fixed, stationary cutter positioned relative to the transfer comb in the path of the bacon slices. The bacon slices may be moved by the transfer mechanism over the at least one cutter.

The invention may take form in various components and arrangements of components, and in various process operations and arrangements of process operations. Further, features and advantages of this invention will become apparent from the following detailed description made with reference to the accompanying drawings.

DESCRIPTION

Figure 1:
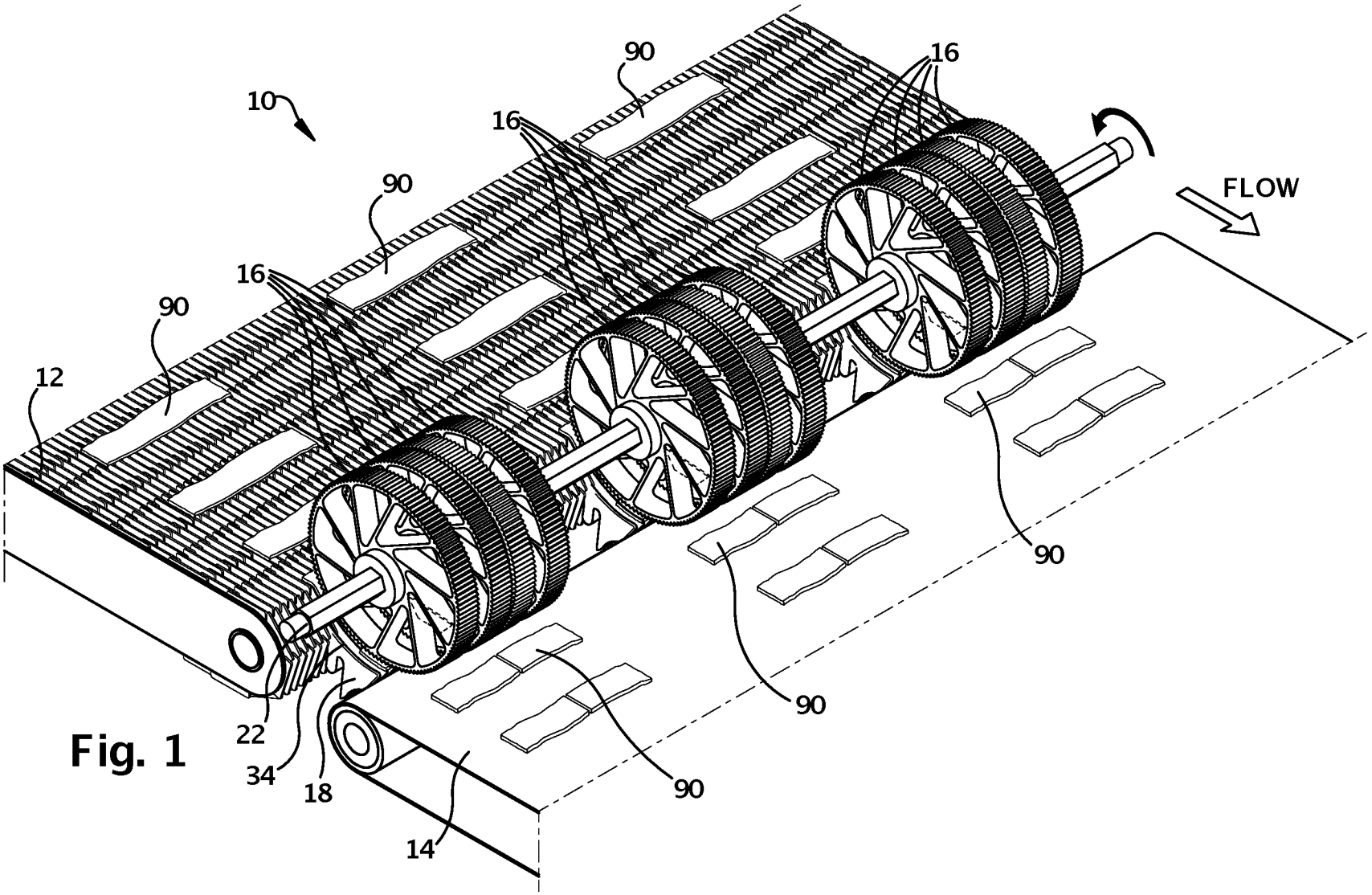
FIG. 1 is a perspective view of an exemplary system including three exemplary bacon lines, each with an exemplary bacon portioner used in the practice of the invention.
Figure 2:
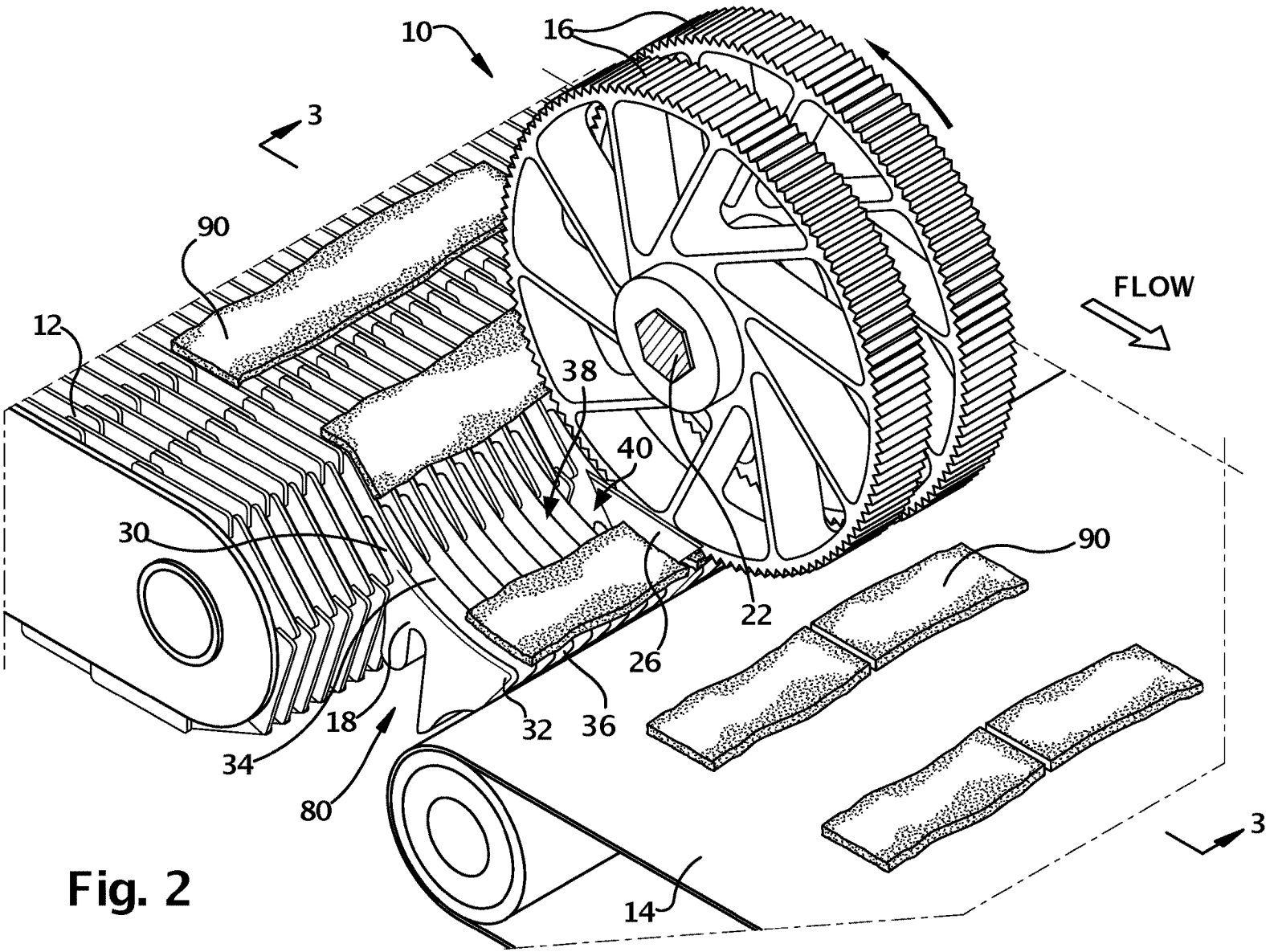
FIG. 2 is a perspective view of one exemplary bacon line of the exemplary system of FIG. 1, wherein two transfer wheels and a portion of a shaft are removed.
Figure 3:
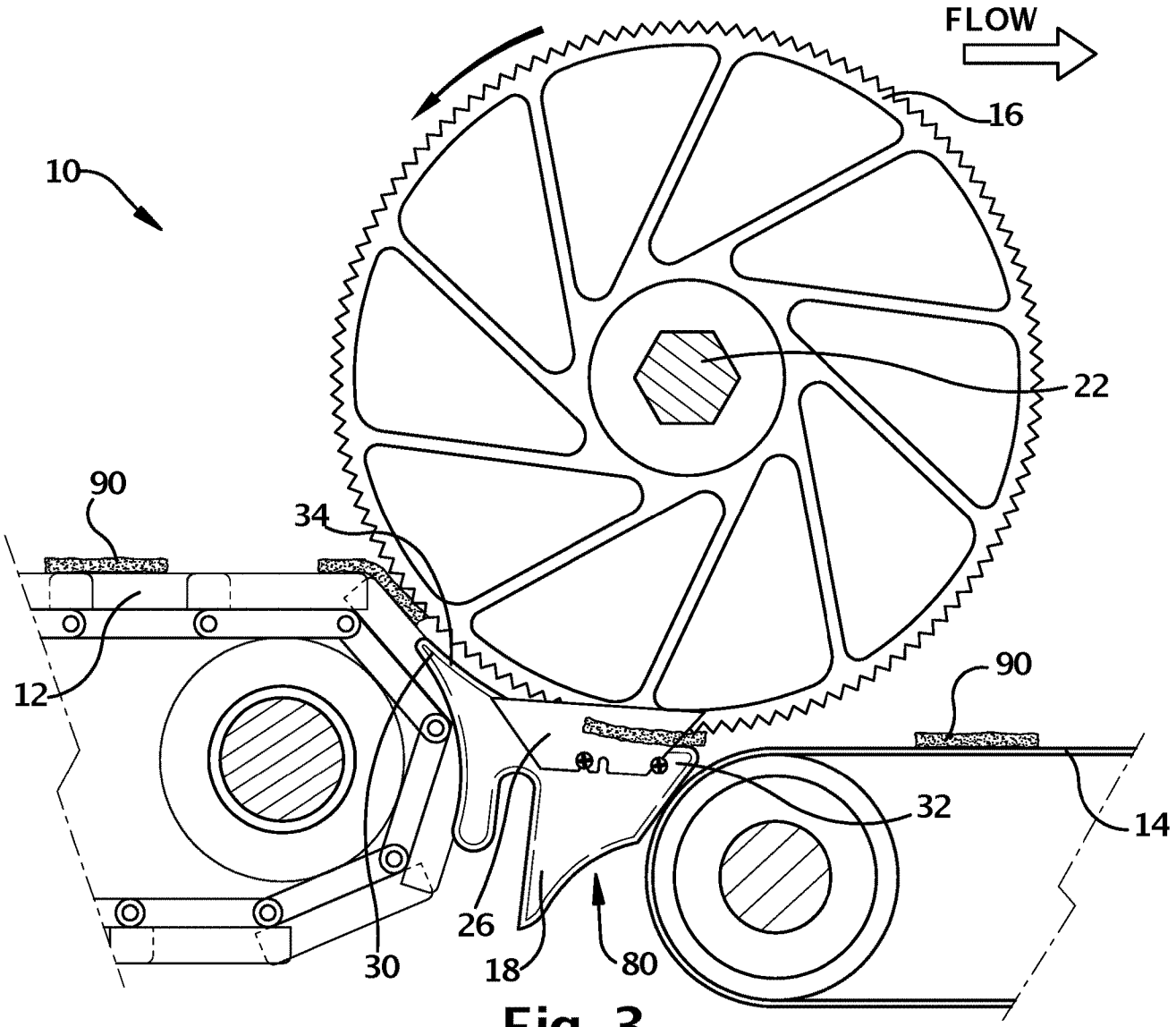
FIG. 3 is a cross sectional view of the exemplary bacon line of FIG. 2 taken along line 3-3.
Figure 4:
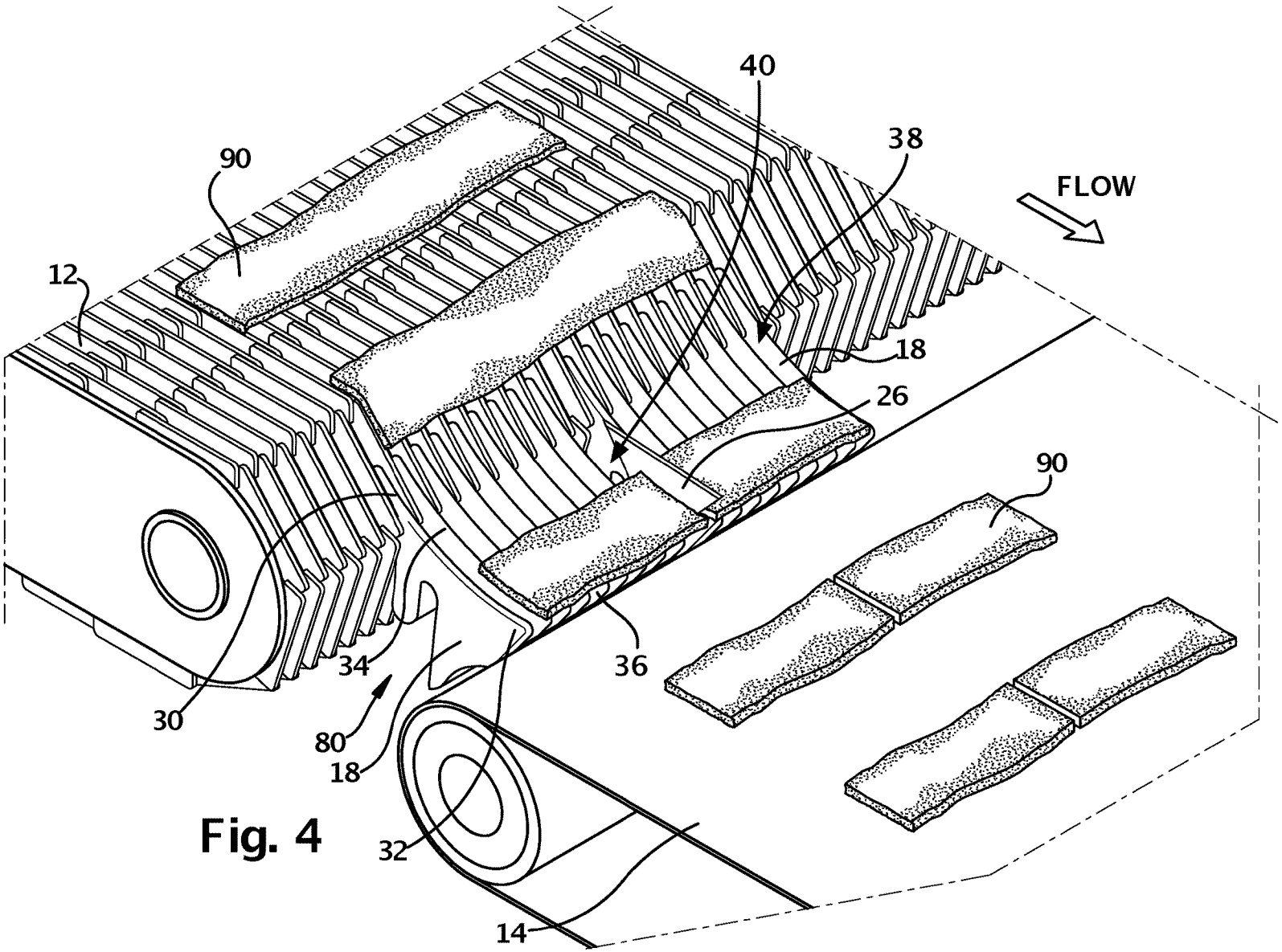
FIG. 4 is a perspective view of the exemplary bacon line of FIG. 2, wherein all the transfer wheels and the shaft are removed.
Figure 5:
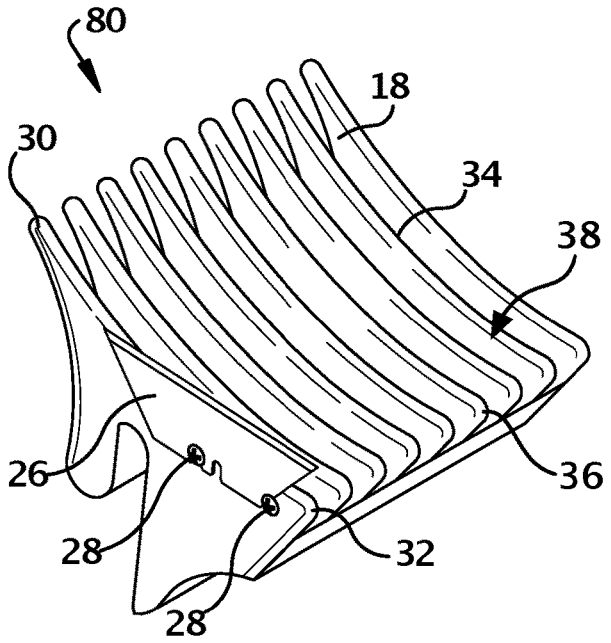
FIG. 5 is a top-right-rear perspective view of an exemplary bacon portioner according to an embodiment of the invention.

The present invention is directed toward various systems, apparatuses and methods for portioning and/or trimming cooked or pre-cooked bacon slices (or another food product) on a production line at full line speed (e.g., greater than 150 slices per minute, or greater than 200 slices per minute, or greater than 250 slices per minute, or about 250 to 370 slices per minute).

An exemplary system of the present invention cuts the bacon (or another food product) into two or more pieces, which may be approximately equal length. A food conveyor of the exemplary system comprises one or more transfer mechanisms (e.g., rotating transfer wheels or a transfer belt) that carry the bacon over a transfer comb positioned between a conveyor belt and a sheeter. The apparatus, or portioner, of the present invention comprises or consists of a fixed, stationary cutter (e.g., a blade or some other cutter, such as a wire or a high-pressure stream of fluid or a laser) mounted or otherwise affixed in the path of the bacon being carried by a food conveyor so that the action of the food conveyor moving the bacon cuts the bacon with the cutter. The cutter may be mounted to the transfer comb in the path of the bacon, and as the transfer mechanisms move the bacon across the transfer comb, the bacon contacts the cutter and is moved by the transfer mechanisms over the cutter, which cuts the bacon into two or more portions of a shorter length. In one exemplary embodiment, the portioner comprises or consists of an ordinary, single-edge utility blade mounted to the transfer comb at an angle to cut the bacon into two or more pieces, which may be of approximately equal length. The exemplary portioner permits bacon to be portioned at full line speed while maintaining accurate piece counts and reasonably accurate placement of the portioned bacon.

FIGS. 1-4 are various views of an exemplary system 10 for portioning bacon slices 90 according to an embodiment of the present invention. The exemplary system 10 includes at least one product transfer wheel 16, a rotating shaft 22, at least one product transfer comb 18, a second conveyor belt 14, and at least one portioner 80 having a cutter 26. The transfer comb 18 includes a plurality of transfer comb members 36 spaced apart to form a plurality of transfer comb gaps 38. A gap 40 is formed between the cutter 26 and the adjacent transfer comb member 36. As shown, the exemplary system 10 is a modified bacon sheeter (e.g., an American Machine Products 2000-C bacon sheeter) receiving bacon slices 90 from a first conveyor belt 12. The portioner 80 is used with the bacon sheeter such that the bacon slices 90 are portioned as the bacon slices move across the transfer comb 18 of the sheeter. Although the portioner 80 is shown installed on a particular bacon sheeter, it is believed that the portioner may be used with a variety of other machines, including sheeters having various types of transfer means. The portioner 80 of the present invention may also be used in connection with other food conveyors, such as conveyor belts. It should also be noted that the portioner 80 is not limited to portioning bacon and meat products, but may be used to portion other food products as well.

As shown in FIGS. 1-4, the first conveyor belt 12 transfers the cooked (or pre-cooked) bacon slices 90 from a cooking device to the system 10. The product transfer wheels 16 of the system 10 are attached to the rotating shaft 22 and positioned such that an outer surface of the wheels is slightly above the curved top surface 34 of the product transfer comb 18. The rotating wheels 16 move the bacon slices 90 from the first conveyor belt 12 and across the top surface 34 of the transfer comb 18 from the first end 30 to the second end 32 of the comb. The rotating wheels 16 then feed the portioned bacon slices 90 onto the second conveyor belt 14. In some embodiments, a sheet of paper is positioned on the second conveyor belt 14. The second conveyor belt 14 moves the sheet of paper forward as the portioned bacon slices 90 are placed on the paper. It is important that the system 10 maintain accurate piece counts and reasonably accurate placement of the portioned bacon slices 90 on the second conveyor belt 14 and/or sheet of paper at full line speed (e.g., about 360 slices per minute, or greater than 150 slices per minute, or greater than 200 slices per minute, or greater than 250 slices per minute, or about 250 to 370 slices per minute). The portioned bacon slices 90 and/or paper are then transferred via the second conveyor belt 14 to a packaging station.

As shown in FIG. 1, the exemplary system 10 includes twelve transfer wheels 16 (i.e., three sets of four transfer wheels) mounted to the rotating shaft 22. However, various configurations of more or less transfer wheels 16 may be used in the practice of this invention. As shown, the two center transfer wheels 16 of each set are moved closer together such that they are positioned on either side of and close to the portioner blade 26 (e.g., about 0.01 inches to about 0.030 inches away from the portioner blade and on either side of the portioner blade, or perhaps even touching the blade). This modification helps prevent tearing of the bacon slices 90 as they are cut by the blade 26. In other embodiments (not shown), the transfer mechanism of the system 10, such as transfer belts, may need to be modified to provide a space for the cutter in the path of the bacon slices 90 and to prevent tearing of the bacon slices as they are cut by the cutter, such as blade 26. For example, conveyor belts may be modified to be positioned on either side of the cutter, such as blade 26.

FIGS. 5-8 depict an exemplary portioner 80 according to an embodiment of the invention. As shown, the portioner 80 consists of a single edge utility blade 26 (e.g., part number 11-921K from Stanley Tools Product Group 480 Myrtle Street New Britain, Conn. 06053) mounted at an angle $\alpha$ on a product transfer comb 18 of the exemplary system 10. As is noted above, the transfer comb 18 includes transfer comb members 36 spaced apart to form transfer comb gaps 38. As the bacon slices move across the top surface 34 of the transfer comb 18 from the first end 30 to the second end 32 of the comb, the fixed/stationary blade 26 portions, or cuts, the bacon slices from below. Various shapes and sizes of blades may be used in the practice of the invention. Further, multiple blades may be used, such as two or more blades attached to the transfer comb to portion the bacon slice into three or more pieces. Optionally, blades may be positioned at the ends of bacon slices and used in accordance with the teachings herein to trim the ends off of bacon slices.

Referring to FIGS. 5-8, the angle α of the blade 26 is measured between the top surface 34 of the transfer comb 18 and the top (i.e., leading edge or cutting edge) of the blade. As an optional aspect of the invention, this angle α may be selected so that as the leading or cutting edge of the blade 26 dulls, the angle allows the bacon slices to slide further up the blade to a sharp portion. As shown, the angle α of the blade 26 is about 18 degrees (with respect to a tangent to the curved transfer comb 18 shown). In the alternative, it is believed that blade 26 angles α of about 14 degrees to about 20 degrees relative to the transfer comb 18 may be used. Of course, other angles may be used as well and fall within the scope of the present application. In the alternative, cutters other than the blade shown may be used, such as other straight blades, curved blades, wires, thin streams of high-pressure fluid, lasers, etc.

Figure 6:
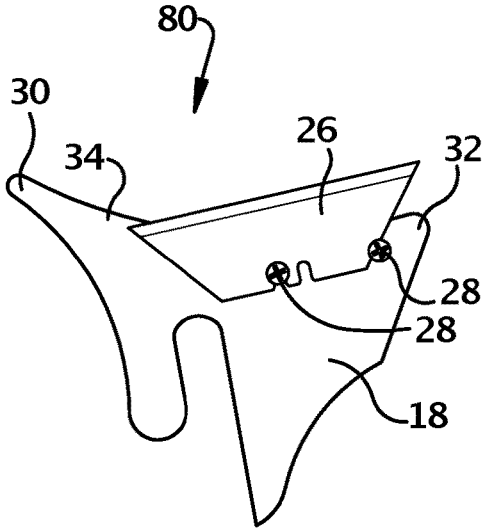
FIG. 6 is a right side view of the exemplary bacon portioner of FIG. 5.
Figure 7:
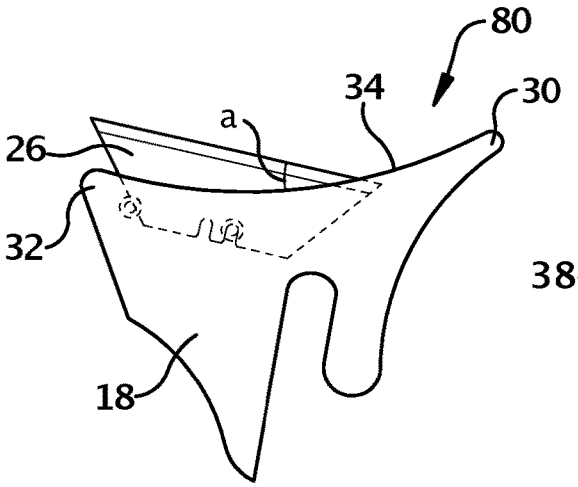
FIG. 7 is a left side view of the exemplary bacon portioner of FIG. 5.
Figure 8:
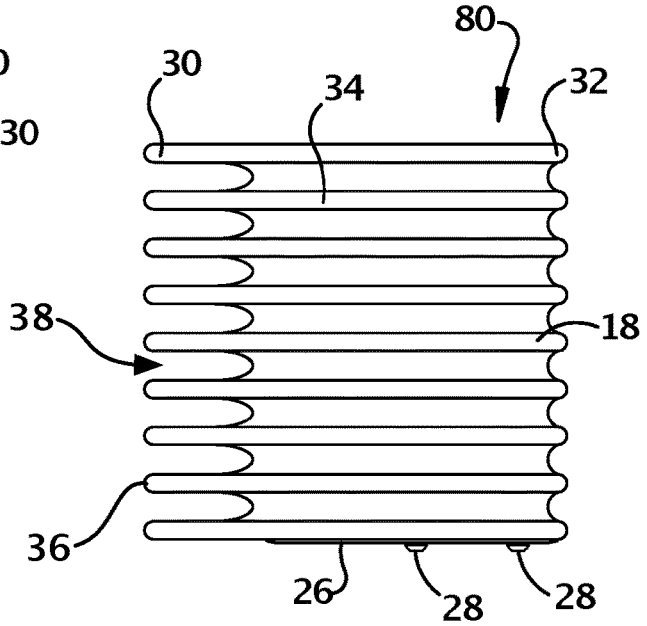
FIG. 8 is a top view of the exemplary bacon portioner of FIG. 5.

The blade 26 of the portioner 80 may be attached to the product transfer comb 18 by any suitable means known in the art, such as for example with a fastener, clip, snap, or pin, or by other methods, such as over-molding a comb over one or more blades or other cutters. As shown, the blade 26 is attached to a side of the product transfer comb 18 by screws 28 (e.g., part number 0177908 from Fastenal 2001 Theurer Blvd. Winona, Minn. 55987). The layout for the screws 28 on the side of the product transfer comb 18 is shown in FIG. 6. This layout allows the blade 26 depicted in the figures to be positioned such that as the leading edge of the blade dulls, the bacon slices will slide further up the blade to a sharp portion.

Figure 9:
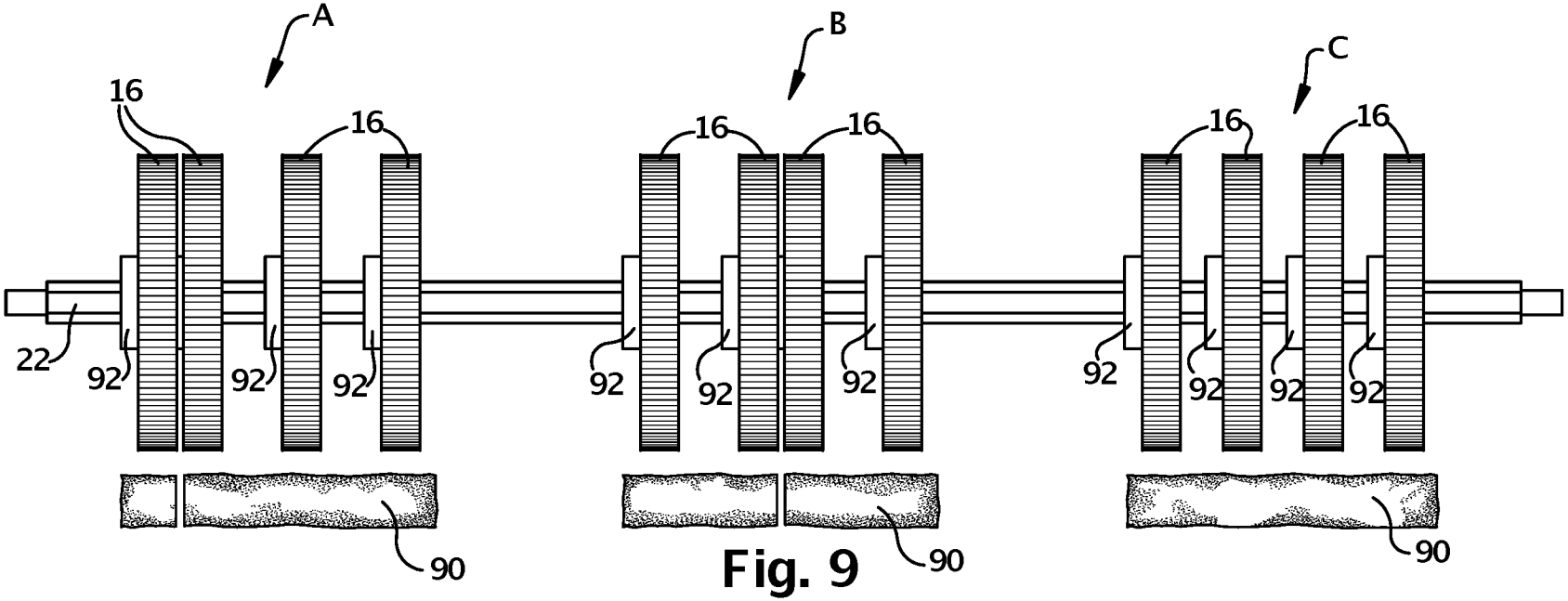
FIG. 9 is a top view of a first configuration of transfer wheels according to an embodiment of the invention.
Figure 10:
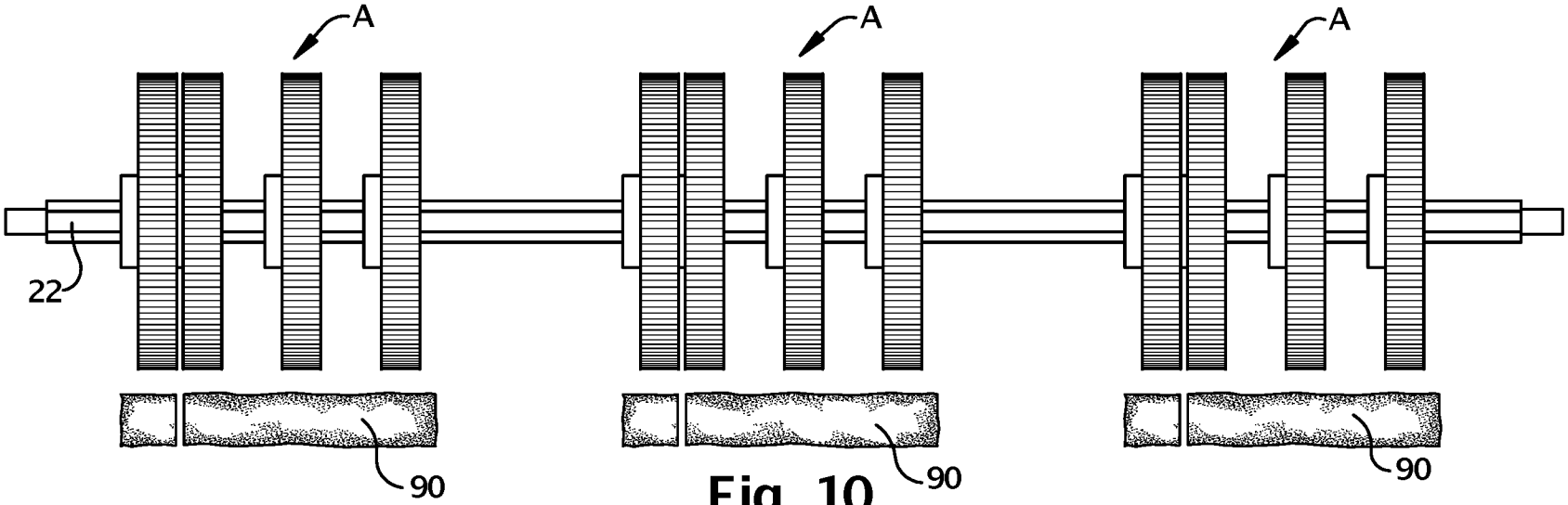
FIG. 10 is a top view of a second configuration of transfer wheels according to an embodiment of the invention.
Figure 11:
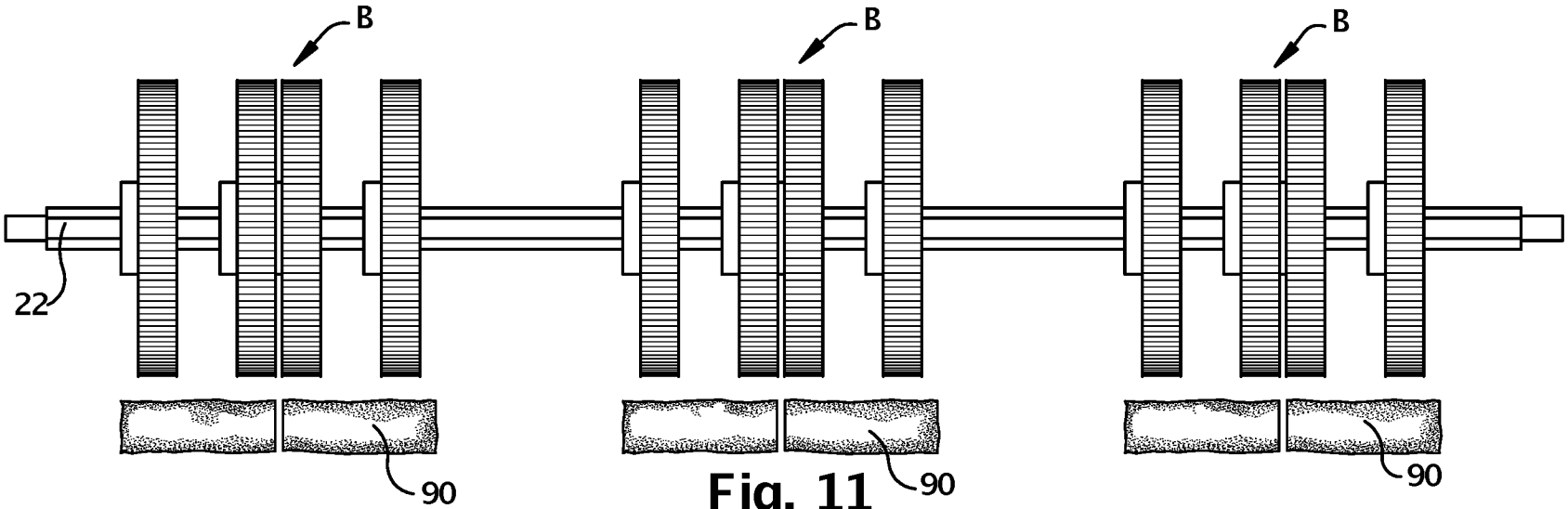
FIG. 11 is a top view of a third configuration of transfer wheels according to an embodiment of the invention.
Figure 12:
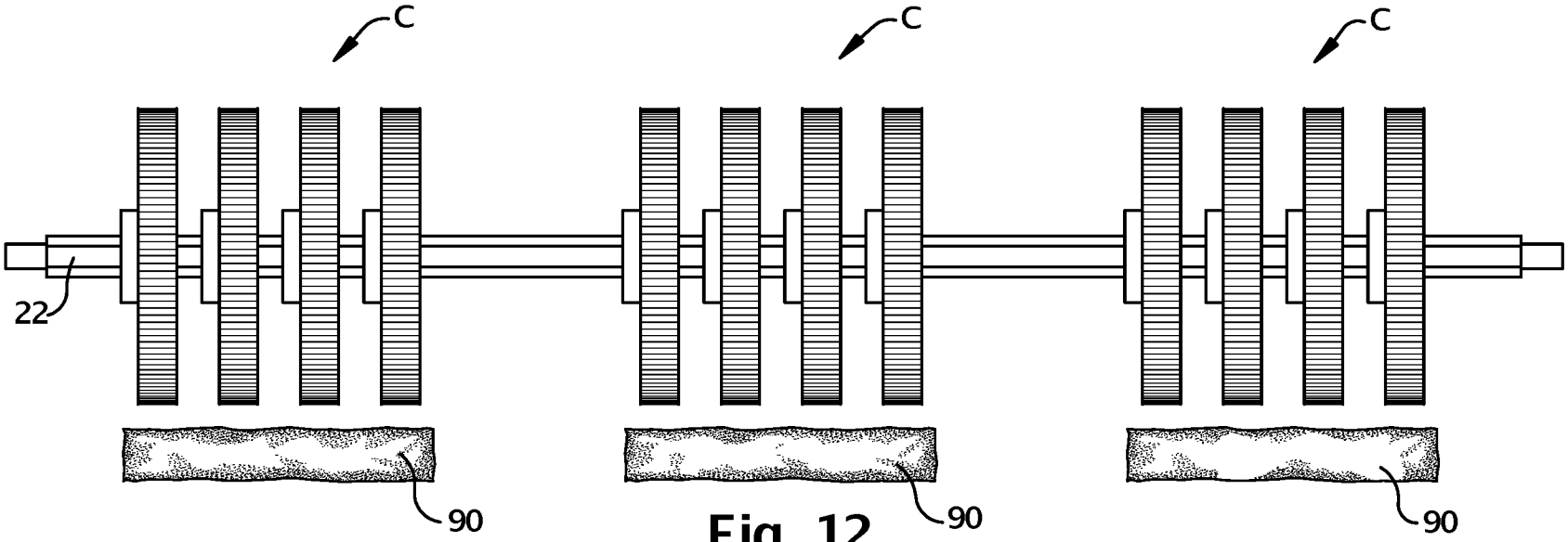
FIG. 12 is a top view of a fourth configuration of transfer wheels according to an embodiment of the invention.

FIGS. 9-12 depict various configurations of product transfer wheels 16 mounted on the rotating shaft 22 of the exemplary system 10. FIG. 9 depicts three configurations (A, B, and C) of the transfer wheels 16 mounted on a single rotating shaft 22. FIG. 10 depicts three sets of transfer wheels mounted on rotating shaft 22 and in modified configuration A. FIG. 11 depicts three sets of transfer wheels mounted on rotating shaft 22 and in modified configuration B. FIG. 12 depicts three sets of transfer wheels mounted on rotating shaft 22 and in a conventional configuration C.

It should be understood that the configurations of transfer wheels depicted in the figures are for exemplary purposes and various configurations of more or less transfer wheels, or other transfer mechanisms (e.g., transfer belts), may be used in the practice of this invention. It should also be understood that these and other configurations may be used with one or more cutters to produce portioned food product having two or more portions of equal lengths (e.g., ½ portions, ⅓ portions, ¼ portions, etc.) or unequal lengths (e.g., ¼-¾ portions, trimming the ends, etc.). Further, in other embodiments (not shown), the transfer mechanism of the system, such as transfer belts, may need to be modified to provide a space for the cutter in the path of the bacon and to prevent tearing of the bacon slices as they are cut by the cutter, such as blade 26. For example, conveyor belts may be modified to be positioned on either side of the cutter, such as blade 26.

In configuration A (shown in FIGS. 9 and 10), the outer two transfer wheels 16 (the first and second transfer wheels) are modified or moved closer together such that they are positioned on either side of and close to the portioner blade (not shown). Thus, the blade of the portioner is positioned between the modified transfer wheels 16. For example, the modified transfer wheels 16 may be about 0.01 inches to about 0.030 inches away from the portioner blade and on either side of the portioner blade, or perhaps even touching the blade. This modification helps prevent tearing of the bacon slices 90 as they are cut by the blade. The outer surface of the modified transfer wheels 16 pinch the cooked or partially cooked bacon slices 90 against the transfer comb (not shown) such that the slices are not torn as they are cut by the blade 26. Further, the second transfer wheel 16 in configuration A has been modified by removing an axial hub extension 92 from transfer wheel 16 to permit the wheels to be positioned very close to each other on either side of the blade 26. With the transfer wheels 16 in configuration A, the bacon slices 90 are portioned towards the end of the bacon slice, with portions of about one quarter a slice and three-fourths of a slice.

In configuration B (shown in FIGS. 9 and 11), the center two transfer wheels 16 (the second and third transfer wheels) are modified or moved closer together such that they are positioned on either side of and close to the portioner blade (not shown). This modification helps prevent tearing of the bacon slices 90 as they are cut by the blade 26. Further, the third transfer wheel 16 in configuration B has been modified by removing an axial hub extension 92 from transfer wheel 16 to permit the wheels to be positioned very close to each other on either side of the blade 26. With the transfer wheels 16 in configuration B, the bacon slices 90 are portioned towards the center of the bacon slice, with portions of about equal length.

In configurations A and B, the close proximity of the modified transfer wheels 16 permit one to see from inspection where the blade has been positioned along the length of the bacon slices 90. For example, in configuration A, the close proximity of the modified transfer wheels 16 at the one side permit one to see from inspection that the blade has been positioned toward one end of the bacon slices 90, with portions of about one quarter a slice and three-fourths of a slice. Similarly, in configuration B, the close proximity of the modified transfer wheels 16 at about the center of the bacon line permit one to see from inspection that the blade has been positioned at about the center of the bacon slices 90, with portions of about equal length.

In configuration C (shown in FIGS. 9 and 12), the transfer wheels 16 are generally spaced equidistantly along the length of the rotating shaft 22. In this conventional or ordinary configuration, the transfer wheels 16 are not modified and the bacon slices 90 are not intended to be portioned by the portioner blade. However, in some embodiments, the portioner blade may be used in conjunction with this configuration of transfer wheels 16 to portion the bacon slices 90.

As should be apparent from the foregoing, the present invention also contemplates methods of modifying a food conveyor to portion food moved by the food conveyor and methods of portioning foods.

While several embodiments of the invention have been illustrated and described in considerable detail, the present invention is not to be considered limited to the precise constructions disclosed. Various adaptations, modifications and uses of the invention may occur to those skilled in the arts to which the invention relates. It is the intention to cover all such adaptations, modifications and uses.

We claim:

1. A method of portioning bacon slices on a production line, comprising:

moving the bacon slices on a first food conveyor belt;

transferring the bacon slices over at least one concave and fixed transfer comb using at least one transfer mechanism, wherein the at least one concave and fixed transfer comb includes a plurality of transfer comb members spaced apart to form a plurality of transfer comb gaps, wherein a first transfer mechanism of the at least one transfer mechanism comprises at least two rotating transfer wheels;

cutting the bacon slices into two or more portions of shorter length using at least one fixed, stationary cutter mounted to the concave and fixed transfer comb in the path of the bacon slices, wherein each cutter of the at least one, fixed stationary cutter is directly mounted to one of the plurality of transfer comb members and a gap is formed between each cutter of the at least one, fixed stationary cutter and an adjacent comb member, wherein the bacon slices are directly contacted and moved by the at least two rotating transfer wheels of the first transfer mechanism over the at least one cutter to perform the cutting;

moving the two or more portions of shorter length from the at least one concave and fixed transfer comb to a second food conveyor belt using the at least one transfer mechanism; and moving the two or more portions of shorter length on the second food conveyor belt;

wherein the two or more portions of shorter length are one quarter to one half the length of the bacon slices prior to being cut by the at least one fixed, stationary cutter.

2. The method of claim 1, wherein the at least one fixed, stationary cutter is a single-edge utility blade mounted to the concave and fixed transfer comb in the path of the bacon slices to cut the bacon slices in two or more portions.

3. The method of claim 2, wherein the production line is running at a speed between about 150 slices per minute and about 370 slices per minute.

4. The method of claim 2, wherein the two rotating transfer wheels are positioned on either side of the utility blade to prohibit tearing of the bacon slices as they are cut by the cutting edge of the utility blade.

5. The method of claim 4, wherein the production line is running at a speed between about 150 slices per minute and about 370 slices per minute.

6. The method of claim 1, wherein the production line is running at a speed greater than about 150 slices per minute.

7. The method of claim 1, wherein the production line is running at a speed between about 250 slices per minute and about 370 slices per minute.

8. The method of claim 1, wherein the at least one fixed, stationary cutter comprises two or more fixed, stationary cutters mounted to the concave and fixed transfer comb in the path of the bacon slices to portion the bacon slices into three or more portions.

9. The method of claim 1, wherein the at least two rotating transfer wheels of the first transfer mechanism comprise two rotating transfer wheels and the at least one fixed, stationary cutter is a single-edge utility blade mounted directly to the concave and fixed transfer comb in the path of the bacon slices to cut the bacon slices.

10. The method of claim 9, wherein the first transfer mechanism comprises the two rotating transfer wheels positioned on either side of the cutter to prohibit tearing of the bacon slices as they are cut by the cutter.

11. The method of claim 1, wherein the at least two rotating transfer wheels of the first transfer mechanism comprise two rotating transfer wheels and the at least one fixed, stationary cutter is a single-edge utility blade mounted directly to the concave and fixed transfer comb in the path of the bacon slices to cut the bacon slices in two.

12. The method of claim 11, wherein the first transfer mechanism comprises the two rotating transfer wheels positioned on either side of the cutter to prohibit tearing of the bacon slices as they are cut by the cutter.

13. The method of claim 1, wherein the first transfer mechanism comprises at least three rotating transfer wheels and the at least one fixed, stationary cutter includes two single-edge utility blades mounted directly to the concave and fixed transfer comb in the path of the bacon slices to cut the bacon slices into three portions.

14. The method of claim 1, wherein the first transfer mechanism comprises at least four rotating transfer wheels and the at least one fixed, stationary cutter includes three single-edge utility blades mounted directly to the concave and fixed transfer comb in the path of the bacon slices to cut the bacon slices into four portions.

15. The method of claim 1, wherein the at least one fixed, stationary cutter cuts the bacon slices into two portions.

16. The method of claim 1, wherein the at least one fixed, stationary cutter comprises two fixed stationary cutters configured to cut the bacon slices into three portions.

17. The method of claim 1, wherein the at least one fixed, stationary cutter comprises three fixed stationary cutters configured to cut the bacon slices into four portions.

18. The method of claim 1, wherein the first transfer mechanism comprises two rotating transfer wheels positioned on either side of the at least one fixed, stationary cutter to prohibit tearing of the bacon slices as they are cut by the cutter.

19. The method of claim 1, wherein a first rotating transfer wheel of the at least two rotating transfer wheels of the first transfer mechanism moves a first portion of the two or more portions of shorter length of the bacon slices to the second food conveyor belt, and a second rotating transfer wheel of the at least two rotating transfer wheels of the first transfer mechanism moves a second portion of the two or more portions of shorter length of the bacon slices to the second food conveyor belt.

20. The method of claim 1, further comprising moving the two or more portions of shorter length of the bacon slices from the second food conveyor belt to a packaging station.

* * * * *